US011503913B2

(12) United States Patent
Tines

(10) Patent No.: US 11,503,913 B2
(45) Date of Patent: Nov. 22, 2022

(54) WIRE SHELF COVER PRODUCT, KIT, AND METHOD

(71) Applicant: Steven M. Tines, Grover, MO (US)

(72) Inventor: Steven M. Tines, Grover, MO (US)

(73) Assignee: JOHN LOUIS INC., Fenton, MO (US)

( * ) Notice: Subject to any disclaimer, the term of this patent is extended or adjusted under 35 U.S.C. 154(b) by 0 days.

(21) Appl. No.: 17/209,832

(22) Filed: Mar. 23, 2021

(65) Prior Publication Data

US 2022/0304467 A1 Sep. 29, 2022

(51) Int. Cl.
*A47B 96/02* (2006.01)
*A47B 96/20* (2006.01)

(52) U.S. Cl.
CPC ..... *A47B 96/021* (2013.01); *A47B 96/201* (2013.01); *A47B 96/205* (2013.01)

(58) Field of Classification Search
CPC .... A47B 96/021; A47B 96/201; A47B 96/205
See application file for complete search history.

(56) References Cited

U.S. PATENT DOCUMENTS 4,635,801 A * 1/1987 Oren ..... B25H 3/04 248/316.1
5,462,177 A * 10/1995 O'Donnell ..... A47B 81/068 211/40
7,131,547 B2 11/2006 Gawel
2002/0170870 A1 11/2002 Callis
2015/0053634 A1* 2/2015 Tines ..... A47B 55/02 211/186

FOREIGN PATENT DOCUMENTS

DE 202014106305 U1 * 5/2015 ..... A47B 47/0008

* cited by examiner

*Primary Examiner* — Matthew W Ing
(74) *Attorney, Agent, or Firm* — Sandberg Phoenix & von Gontard PC

(57) ABSTRACT

A method for restoring the visual appearance of a wire shelf, products employed in the method, and a kit containing the parts used for the restoration are provided for simplifying the process of altering the appearance of a wire shelf construction. The kit preferably includes a top surface covering having adjustable depth dimensions using joinable segments. A profile is adapted and configured to engage with the top surface covering. Fasteners coupled the front profile to the wire shelf.

15 Claims, 8 Drawing Sheets

1
20
20
3
20

3
1

1
6

25
7

25
8

10
12
13
14

10
12
13
14

WIRE SHELF COVER PRODUCT, KIT, AND METHOD

CROSS-REFERENCE TO RELATED APPLICATIONS

Not Applicable.

STATEMENT REGARDING FEDERALLY SPONSORED RESEARCH

Not Applicable.

BACKGROUND

This invention relates generally to shelf coverings, and more particularly, pertains to products, kits and methods of application which may be utilized by a homeowner or other installer to upgrade the finished look of wire shelving, commonly found in homes and businesses. While the disclosure is specifically described in terms of wire shelving, those skilled in the art will recognize the wider applicability of the inventive principles disclosed hereinafter.

Wire shelves are commonly used in new building construction and appear, especially, in both closets and pantries in both residential and commercial buildings. Their popularity stems from their low-cost, easy removal from the closet or pantry, for example, and their lightweight construction. Nevertheless, a number of problems have surfaced with this type of shelf. Because of the shelf construction using cross bars, for example, clothing rested upon the shelf can assume the pattern of the cross bars over time. That result is unacceptable to users even if they are not counted among the most fastidious dressers. Additionally, when certain types of a small base and/or tall items are placed upon the shelf, the spacing between the cross bars can cause the items to fall over. The problem can be more acute when small items are stored. If the items are fragile or not closed completely, unintended spillage of any stored contents may occur.

Regardless of these problems, many users, especially homeowners, find the shells unattractive. A substantial industry has developed for upgrading closets and pantries, for example, in which the shelves are removed and replaced with wood or imitation wood products. While replacement products work well for their intended purposes, they normally are expensive, limiting their market to users willing to bear the expense for improved looks. Replacing an existing shelf in its entirety is also costly and time consuming.

The prior art discloses a number of attempts to solve the problems associated with wire shelves. In general, these solutions merely attempt to place something along the upper boundary of the shelf surface. These types of solutions are insufficient as, for example, they do not cover the front of the existing wire shelf and they may not be secured to the existing wire shelf. Other solutions employ a combination of parts including a front face and a top cover that slots into the front face with the top cover being scored such that it can be cut to the appropriate depth. Such solutions are insufficient because they require modification of parts such by cutting a top cover. This requires additional tools and associated danger while handling a cutting tool. Furthermore, an unskilled installer can damage the top cover by mishandling the cutting tool.

The wire shelves themselves, come in a number of configurations. When used in closets, besides the shelf itself, a depending bar is provided for hanging articles of clothing below the shelf. When used in pantries, the shelf construction is modified to eliminate the depending bar. I have devised a unique combination of unique parts, preferably sold in kit form, which enables a homeowner or installer to enhance the appearance of a wire shelf regardless of the particular construction employed for the shelf. As later described in greater detail, the parts include or are available in three different lengths, different depths, and in various colors and material construction. When assembled in a preferred kit form, each kit includes a length(s) of a larger profile molding, a length(s) of medium profile molding, and a length(s) of small profile molding. In addition, aluminum clips, spacers, and associated fastening devices, preferably bolts, are employed to permit the profile molding to be attached securely to the wire shelf. The kit also includes a plurality of top cover segments of different depths which can be selectively interconnected which enables an installer to adjust what becomes the top of the wire shelf to varying wire shelf depths. The finished product substantially improves the appearance of the wire shelf, and the final result is comparable to the more expensive custom designs available in the market.

BRIEF SUMMARY

In accordance with this disclosure and generally stated, a restoration product preferably in kit form and method of installation are provided for enhancing the appearance of wire shelves. When provided in kit form, the kit is made available in varying length and width dimensions and includes a top surface covering, a front profile covering and a plurality of clips for attaching the top surface and profile covering to the underlying wire shelf. The kit is designed to accommodate various widths and depths of the underlying wire shelf and the front face profile of the shelf. The installation method is simplified in that the top cover has depth dimensions that are alterable using multiple segments with dovetail joint connections for easy removal of material not needed for a particular application.

The foregoing and other objects, features, and advantages of the disclosure as well as presently preferred embodiments thereof will become more apparent from the reading of the following description in connection with the accompanying drawings

DESCRIPTION OF THE DRAWINGS

In the accompanying drawings which form part of the specification.

In the figures, corresponding reference characters and symbols indicate corresponding parts throughout the several views of the drawings.

DETAILED DESCRIPTION

Figures 1A, 1B, 1C, 1D, 1E, 1F, 1K:
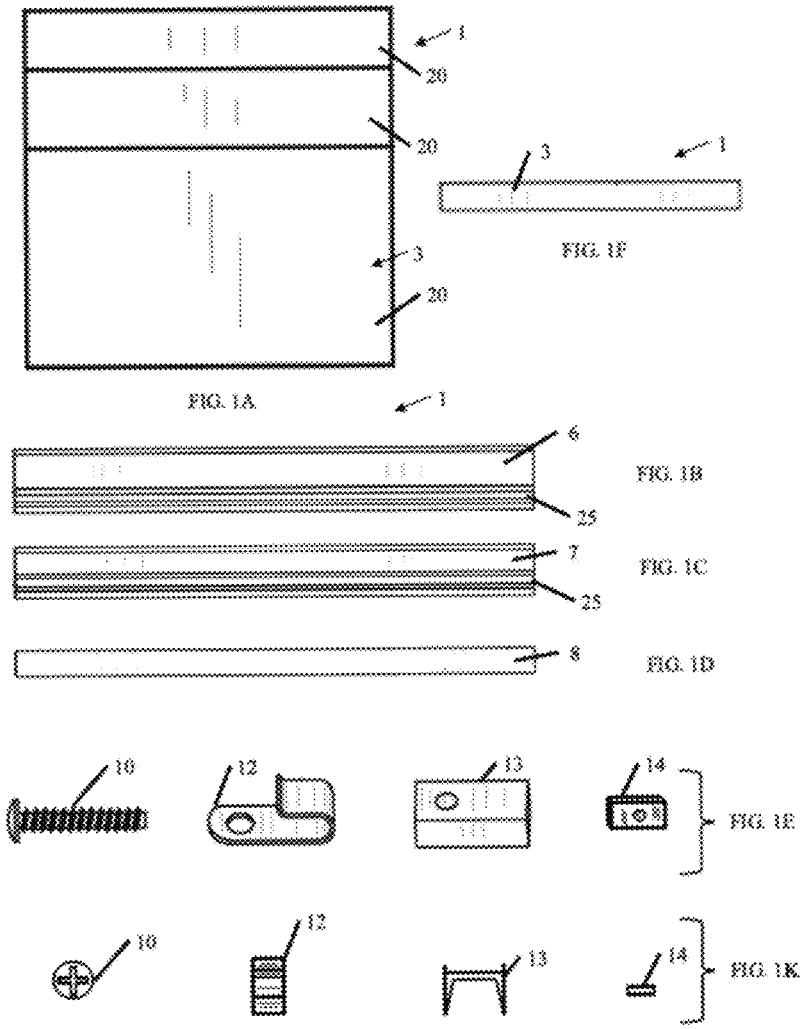
FIGS. 1A-1K are plan views, partly in perspective, of one illustrative embodiment of a wire shelf restoration assembly of the present disclosure.
Figure 1G:
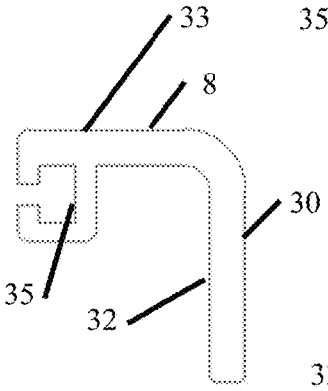
Figure 1H:
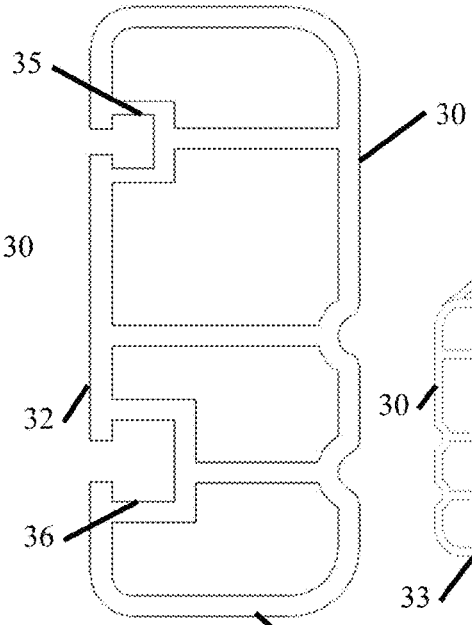
Figure 1I:
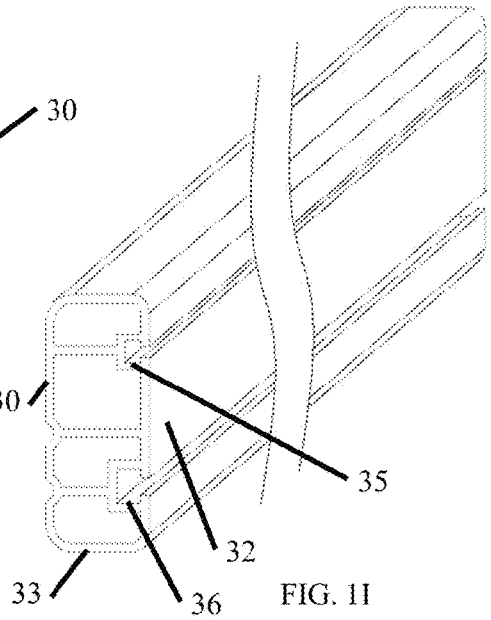
Figure 1J:
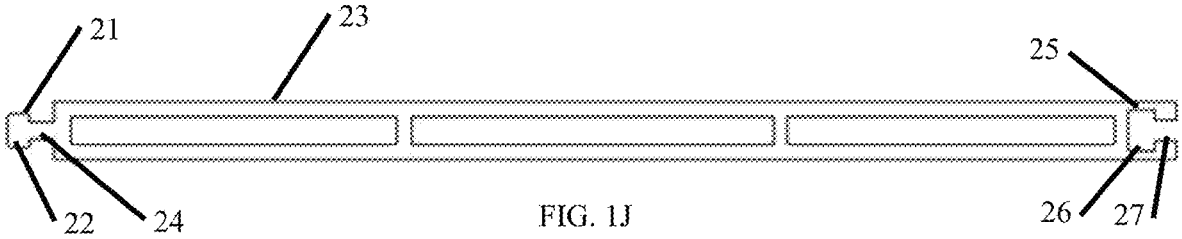

The following detailed description illustrates the wire shelf cover and associated method by way of example and not by way of limitation. The description clearly enables one skilled in the art to make and use the wire shelf cover, describes several embodiments, adaptations, variations, alternatives, and uses of the wire shelf cover, including what is presently believed to be the best mode of carrying out the invention.

Referring now to FIGS. 1A through 1K, reference numeral 1 indicates one illustrative embodiment of shelf cover assembly of the present disclosure. As will be appreciated by those skilled in the art, individual components of the assembly 1 may be provided or sold separately and/or in a number of combinations. The preferred embodiment is in the form of an all-inclusive package or kit that is universally applicable to the majority of wire shelf systems available and/or installed in many businesses and homes. As illustratively shown in FIGS. 1A-1K, the assembly 1 includes a shelf panel or top cover 3 (i.e., a top surface covering assembly); a plurality of front profiles or shelf rail covers 6, 7 and 8; a plurality of top surface covering segments 20 together forming a top surface covering assembly; a series of fasteners 10 and 14; at least one clip 12; and a spacer 13. The specific count of the various components of the assembly may vary, as may the specific aesthetic composition of the various components.

Figure 2A:
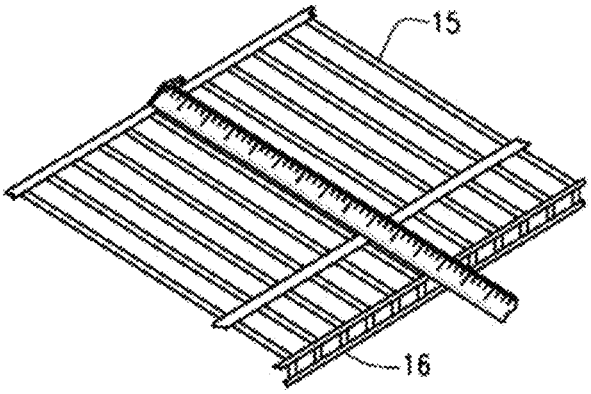
FIGS. 2A-2B are views partly in perspective of an initial installation step for the assembly of FIGS. 1A-1K.
Figure 3A:
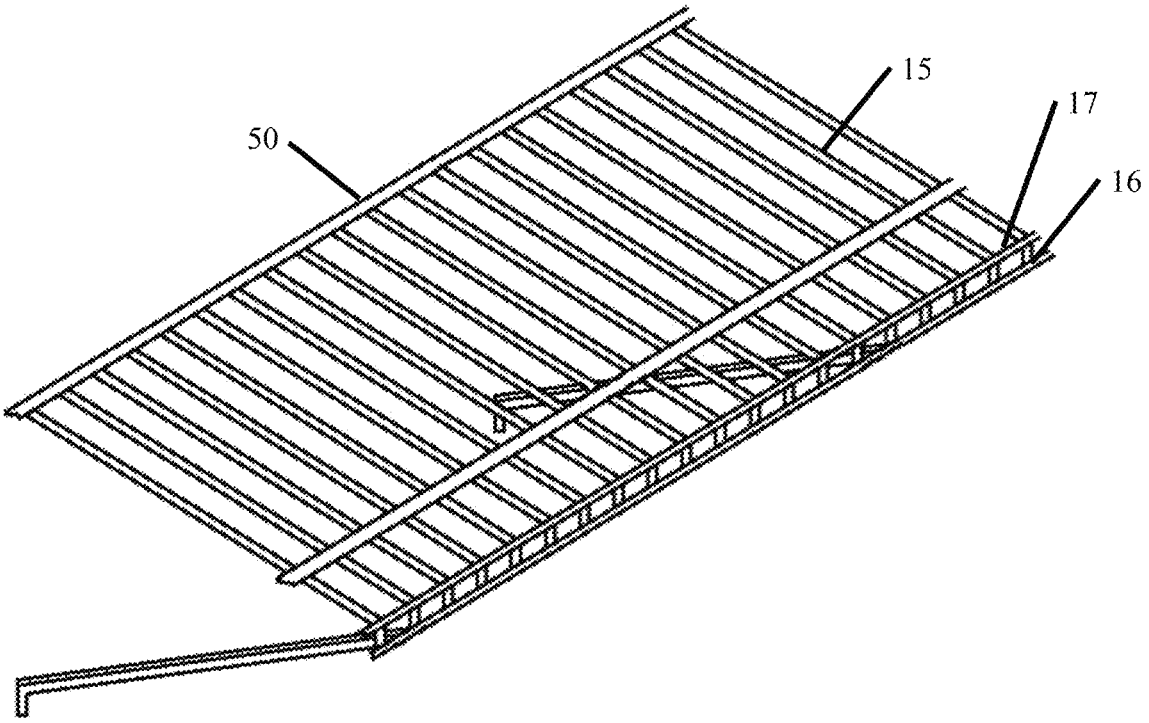
FIGS. 3A-3F are views partly in perspective of additional installation steps for the assembly of FIGS. 1A-1K.
Figure 3B:
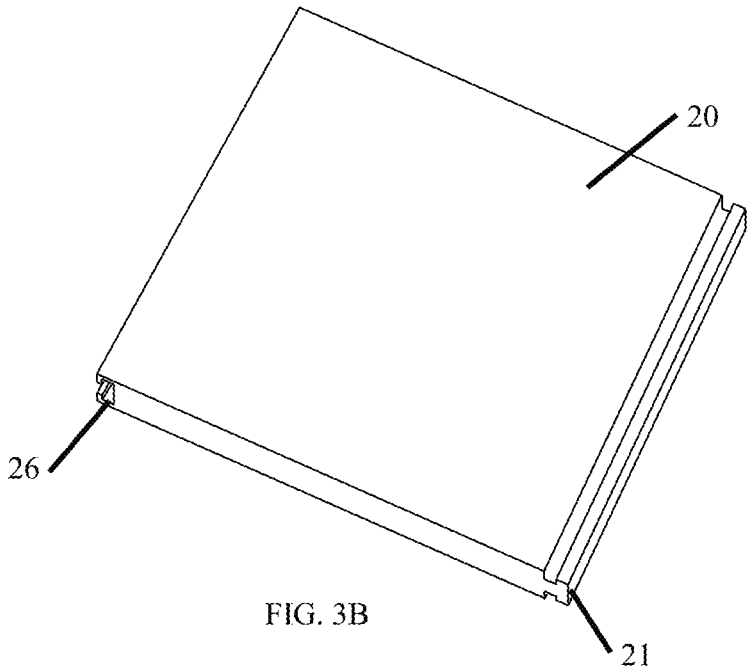
Figure 3C:
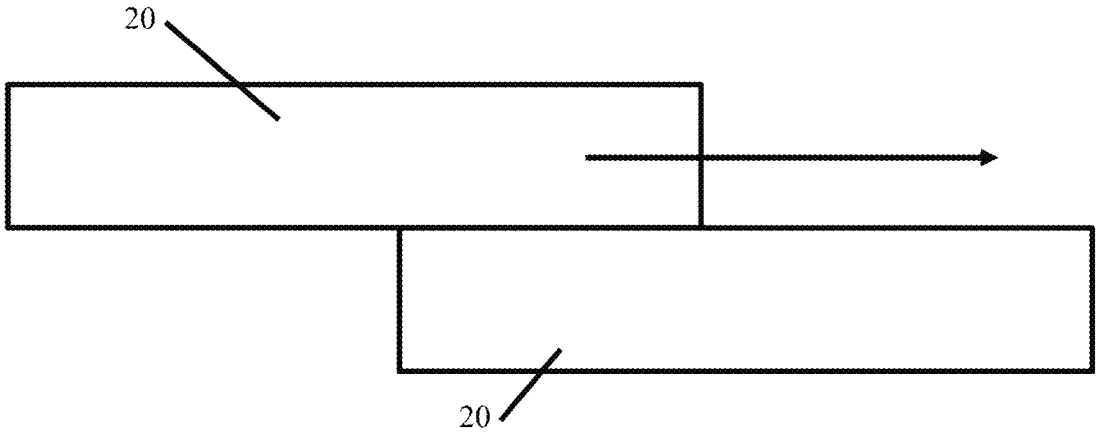
Figure 6A:
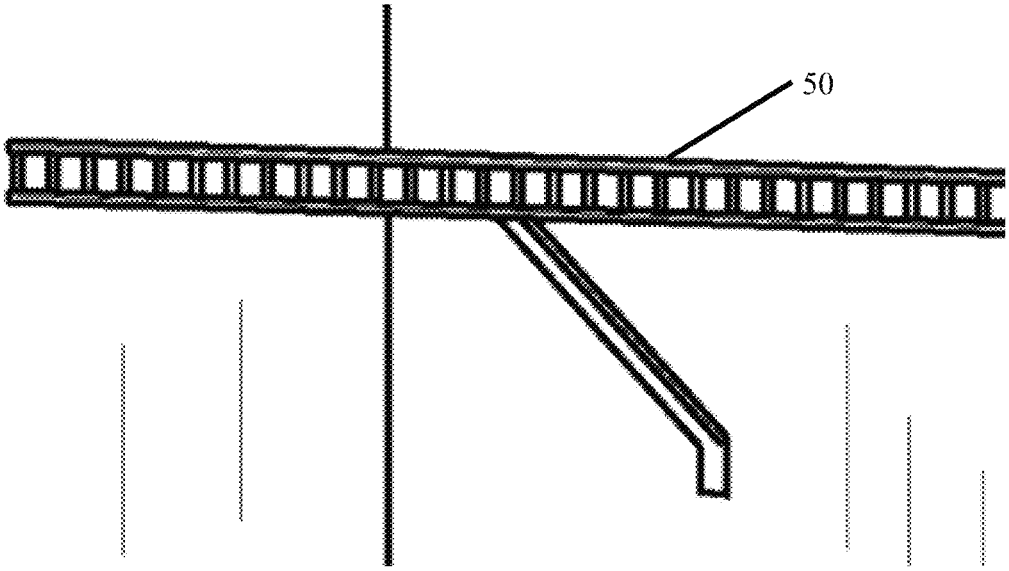
FIGS. 6A-6B are views in perspective of a before and after installation using the assembly of the present disclosure.

Referring now generally to FIGS. 2A, 3A, and 6A, as will be appreciated, commonly available or typical wire shelf products include a top support 15 and a front rail or profile 16. The particular details for typical wire shelf construction are not described in detail, but the shelves themselves have become nearly ubiquitous in the construction industry. While as indicated, the particular details of the shelves may vary somewhat, the most common forms have a front profile or front rails commonly having a height dimension of 1 inch, 2 inches, and 2½ inches. Likewise, the shelves themselves commonly have a depth dimension of 12, 16, or 20 inches. The front rails 16 typically include at least one wire rail 17 where the front rail 16 meets the top support 15. It should be understood that wire shelving can deviate from the examples illustrated herein and that the general principles of the shelf cover assembly 1 disclosed can still apply to upgrade such an existing wire shelf. For example, the positioning, attachment mechanism, and/or physical structure of one or more of the series of fasteners 10 and 14, the at least one clip 12, and/or the spacer 13 may vary for use with other configurations of existing wire shelves.

Referring now to FIGS. 1A, 1F, 1J, 2A-2B, and 3B-3C, the shelf cover 3 preferably is constructed from plastic, although those skilled in the art will recognize that other materials may be employed (e.g., wood), if desired. Because of the variations in wire shelf constructions, I prefer to sell the shelf cover assembly of the present disclosure in kit form. However, again as will be appreciated by those skilled in the art, individual components or various combinations of the kit components may be sold separately, if desired.

Figure 2B:
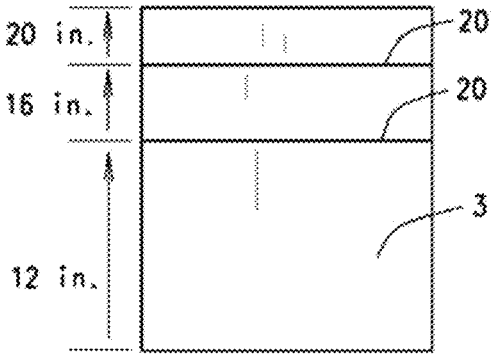

Because of the variations in wire shelf constructions and configurations, the method of use for the products described above also is described with respect to each of the shelf depths and/or profile depths available. In utilization of the assembly 1 of the present disclosure, the first step, regardless of shelf depth is to measure the depth of the shelf. As indicated, the shelf top cover assembly 3 has various segments 20 that can be selectively added or removed to for a shelf top cover assembly 3 having a 12, 16, or 20 inch depth depending on the number of segments 20 coupled to the remainder of the assembly 1. The assembly 1, in kit form, can include a variety of segments 20 of various depths (as shown in FIG. 2B, e.g., 12 inches and 4 inches). In utilizing the assembly, the shelf depth is measured (as shown in FIG. 2) and once determined, the cover assembly 3 is assembled using the number of segments 20 for the required shelf depth. As will be appreciated, if a shelf depth varies from the available configurations of segments 20, a different cover depth can be cut from a segment 20 with a conventional saw.

The segments 20 can be joined or un-joined using a dovetail joint. To provide for dovetail joinery, each segment 20 includes a pin 21 and a tail 25. The pin 21 includes a rectangular cross-section portion 22 coupled to the body 23 by a narrower section 24. The tail 25 includes slot 26 corresponding in cross section to the rectangular cross-section portion 22 such that the pin 21 can be received in the tail 25. The narrower section 24 of the pin passes through a throat 27. That the throat 27 is narrower than the slot 26 locks the pin 21 into the tail 25 longitudinally when inserted laterally into the slot 26. It should be understood that the cross-sections of the pin 21 and tail 25 can vary while maintaining the function of a dovetail joint, but the rectangular cross-section is the preferred embodiment as it gives improved joining performance in rigidity.

The segments 20 can be solid or in the preferred embodiment can include a plurality of cavities. The top surface of the segment 20 is substantially solid to prevent stored items from falling through and the imprinting of the wire pattern previously described.

Referring now to FIGS. 1B-1D, 1H, 1I, 3D, and 3F, the assembly of the rail or profile covers 6, 7, and 8 (i.e., front profiles) having height dimensions of 2.5 inches, 1.75 inches, and 0.8125 inches respectively are similar to one another. Each front profile 6, 7, and 8 has a depth of 0.75 inches. It should be understood that these dimensions are illustrative only and that the dimensions can vary while maintaining the functionality described herein. The correct or desired shelf rail profile height is determined by the height of the front face 16 on the wire shelf. Each of the front profiles 6, 7, and 8 have a front face 30 and a rear face 32 separated by a material thickness 33 of material from which the respective profiles are constructed. The rear face 32 of the profiles 6, 7, and 8 have a dovetail joint tail (e.g., a slot) 35 formed in them and sized to accept a pin 21 of a top surface covering assembly segment 20. The slot 35 is of the type described above with respect to the tail 25 of a top surface covering assembly segment 20.

The rear face of the profiles 6, 7 further includes a second slot or groove 36 formed in them and sized to accept one of the fasteners 14. The second slot or groove 36 is positioned below the slot 35 used in the dovetail joint. The fasteners 10 and 14 and the spacer 13 are used to attach the clip 12 to the respective profile covers 6 and 7 and to the wire rail 17 of the existing wire shelf 50. The bolt/screw fastener 10 is passed through the clip 12 and the spacer 13 and the square profiled nut 14 is threaded onto the bolt/screw 10. The hook end of the clip 12 is placed over the wire rail 17 and the nut 14 is placed within the second slot or groove 36. The spacer 13 positions the clip 12 relative to the rear face 32 of the profile 6 or 7. In some installations, the spacer 13 is omitted as needed to position the clip 12 to secure the profile 6 or 7 (and by extension the top cover assembly 3) to the existing wire shelf 50. The bolt/screw 10 is tightened to secure the clip 12 to both the profile 6 or 7 and the wire rail 17 of the existing wire shelf 50. In embodiments where front profile 8 is used, there is no second slot or groove 36. In such cases the profile 8 and associated top cover assembly 3 can be secured to the existing wire shelf 50 using double sided tape or other suitable fasteners. Alternatively, the profile 8 and associated top cover assembly 3 remain in place by gravity and friction alone.

The front profile 6 or 7, includes a plurality of cavities extending the length of the front profile 6 or 7. In alternative embodiments, the front profile 6 or 7 is capped or solid. In embodiments where the front profile 6 or 7 includes a plurality of cavities running the length thereof, the assembly 1 (e.g., upgrade kit) includes end caps 37 and at least one intermediate cap 39 described in greater detail herein with respect to FIGS. 4A-5C.

The clip 12 has a hook portion adapted and configured hang on a wire rail 17. The hook portion can include an outward flair to assist in placing the hooked portion over the wire rail 17. The nut 14 has a rectangular profile that corresponds to the profile of the second slot or groove 36 such that the nut 14 will not rotate when placed within the second slot or groove 36. The spacer 13 has a rectangular top and side profile and a "bridge" like profile along the other side. The spacer 13 has a beam and two tapering legs extending therefrom. From the other side of the beam, two retaining lips extend which assist in position the clip 12. The clip 12 being positioned between the retaining lips.

Figure 4A:
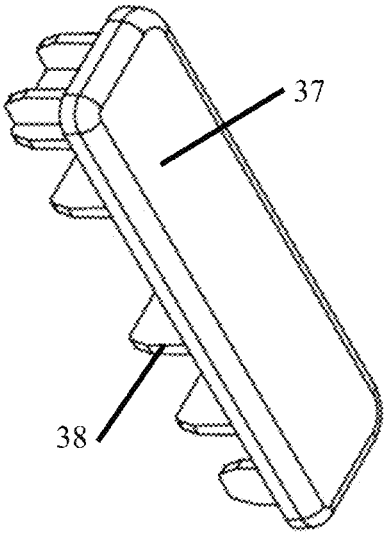
FIGS. 4A-4C are views showing a cap for a front profile of the assembly of FIGS. 1A-1K.
Figure 4B:
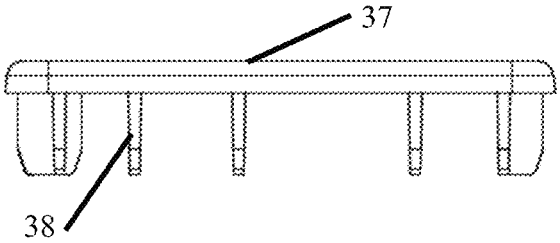
Figure 4C:
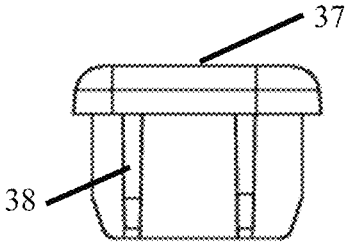

Referring now to FIGS. 4A-4C, an end cap 37 is shown in perspective, side plan, and end plan views, respectively. The end cap 37 is adapted and configured to couple to an end of the front profile 6 or 7. The end cap 37 includes a plurality of tabs 38. The tabs 38 are adapted and configured to extend within the cavities of the front profile 6 or 7 and engage with the interior sides of the front face 30 and rear face 32 to hold the end cap 37 in place using a combination of friction and spring tension. An end cap 37 is coupled to each end of the front profile 6 or 7 during installation of the assembly 1.

Figure 5A:
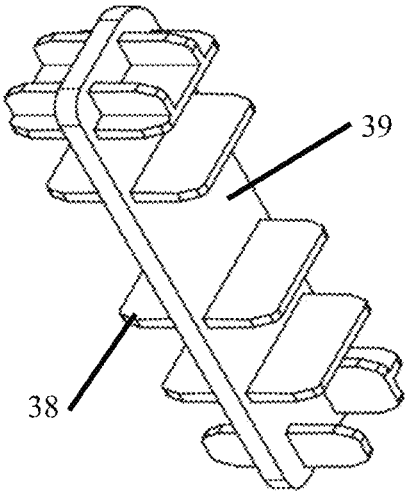
FIGS. 5A-5C are views showing a cap for a front profile of the assembly of FIGS. 1A-1K.
Figure 5B:
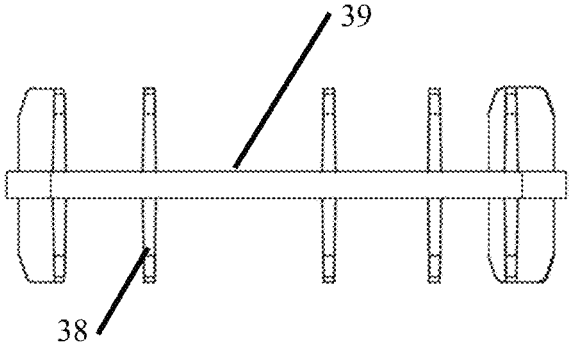
Figure 5C:
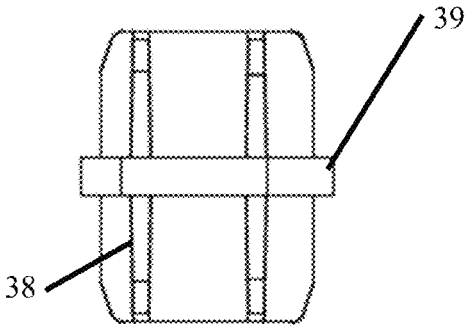

Referring now to FIGS. 5A-5C, an intermediate cap 39 is shown in perspective, side plan, and end plan views, respectively. The intermediate cap 39 is adapted and configured to couple two front profiles 6 or 7 together. The intermediate cap 39 differs from an end cap 37 in that the intermediate cap 39 includes tabs 38 on both sides of the body portion. This allows the intermediate cap 39 to interface with two front profiles 6 or 7 and joint the two front profiles together. By joining multiple front profiles together, the assembly 1 can be used to upgrade an existing wire shelf 50 of any length. Multiple lengths of segments 20 can be coupled side by side as well as extending in the depth dimension. In some embodiments, the assembly 1 includes front profiles 6, 7, or 8 of the same or varying lengths such that multiple front profiles can be joined to match the common lengths of wire shelving. If needed, a front profile 6, 7, or 8 can be cut to length to accommodate an existing shelf of uncommon length.

Figure 6B:
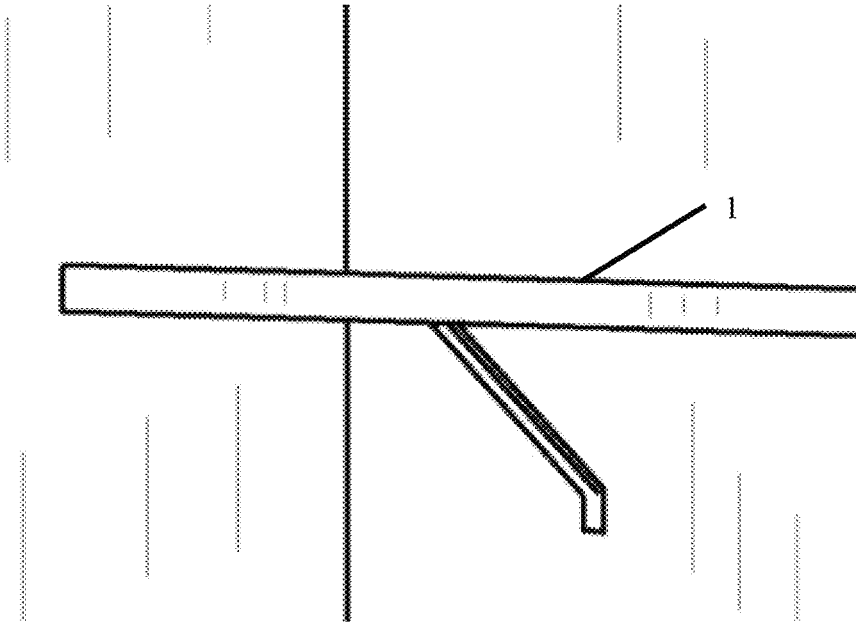

Use of the assembly 1 dramatically enhances the visual appearance of common wire shelves 50. That difference is illustrated in FIGS. 6A and 6B. The assembly 1 gives a substantial upgrade in appearance after installation and does so at reasonable cost. The assembly 1 provides this solution easily as no cutting of materials is typically required due to the dovetail joining system, the end caps, and intermediate caps. The dovetail joining also provides for a secure connection between all components without requiring adhesives or other securing equipment—fasteners only being used to secure the assembly to the wire shelf 50. The top cover assembly 3 is also positively couples to the front profile 6 or 7 using the dovetail joint which provides stability.

Referring now to FIGS. 2A-6B, the assembly 1 is used to upgrade an existing shelf 50 using the following method. The existing wire shelf 50 is measured (as shown in FIG. 2A, 3A). Depending on the depth of wire shelf 50, appropriate top cover assembly segment(s) 20 are selected (as shown in FIG. 3B). If multiple top cover assembly segments 20 are required for the depth of the existing shelf 50, the segments 20 are assembled into the top cover assembly 3. The segments 20 are assembled by sliding the pin 21 of one segment 20 into the tail 25 of another segment 20 (as shown in FIG. 3C). The segments 20 can be joined serially to get the top cover assembly 3 to the appropriate depth.

Figure 3D:
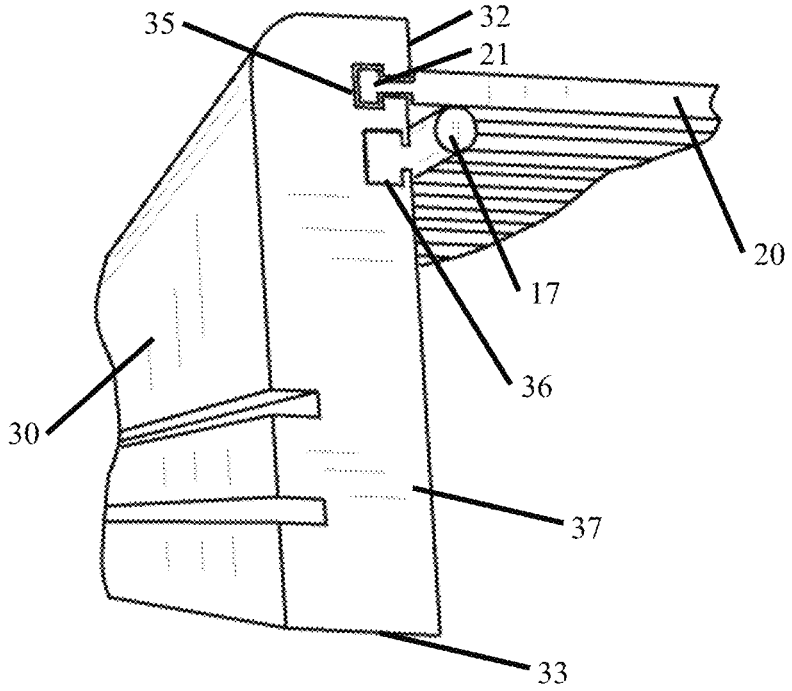
Figure 3E:
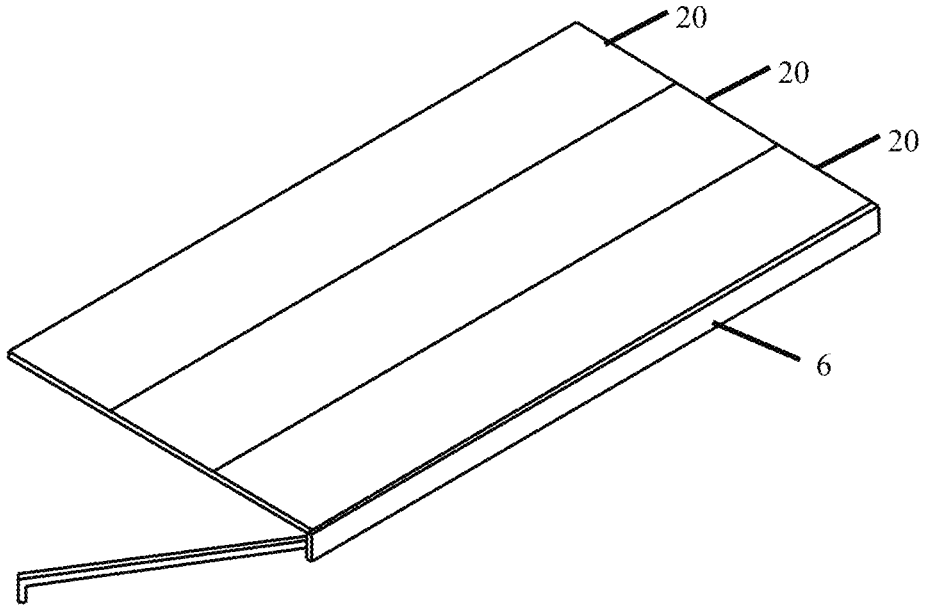

After the top cover assembly 3 segments 20 are joined to form a top cover assembly 3 of the appropriate depth, the leading segment 20 is joined to the front profile 6, 7, or 8 (as shown in FIG. 3D). The leading segment 20 is joined to the front profile 6, 7, or 8 by sliding the pin 21 into the slot 35 of the front profile. The joined top cover assembly 3 and the front profile are placed on the existing shelf 50 (as shown in FIG. 3E).

At this point, or a prior point, or later point, in the method of using the assembly 1, the end caps 37 and any intermediate caps 38 are coupled to the front profile(s) 6 or 7. The additional front profiles 6 or 7 and accompanying segments 20, if needed, can also be coupled using the intermediate caps 38. In alternative embodiments, the end caps 37 are placed as the last step.

Figure 3F:
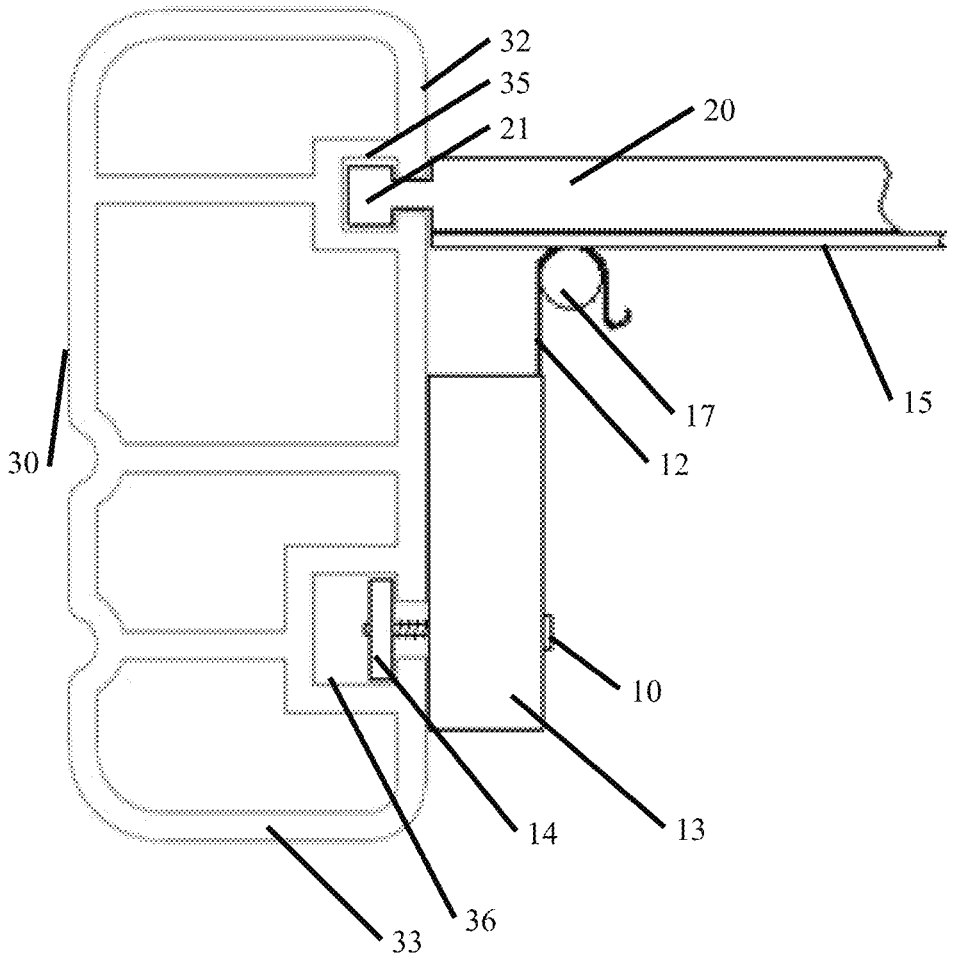

The top cover assembly 3 and front profile(s) 6 or 7 are coupled to the existing wire shelf 50 using the fasteners 10, 12, 13, and 14 (as shown in FIG. 3F). The top cover assembly 3 including segment 20 is resting on top of the top support 15 of the existing shelf 50. The screw/bolt 10 is inserted through the clip 12 and the spacer 13. The nut 14 is threaded onto the screw/bolt 10. The assembly of fasteners is then coupled to the wire rail 17 and the front profile 6 or 7. The hook portion of the clip 12 is placed over the wire rail 17. The nut 14 is inserted into the second slot or groove 36. The bolt/screw 10 is then tightened to secure the clip 12 against the wire rail 17 and the spacer 13 and the spacer 13 against the rear face 32 of the front profile 6 or 7. If not done already, the end caps 37 can be applied.

Changes can be made in the above constructions without departing from the scope of the disclosure. It is intended that all matter contained in the above description or shown in the accompanying drawings shall be interpreted as illustrative and not in a limiting sense.

What is claimed is:

1. A method for wire shelf restoring by upgrading and changing the visual appearance of an associated wire shelf, the wire shelf having a top surface and front face, the top surface and front face each having fixed length and depth dimensions, comprising:

providing a top surface covering assembly for the associated wire shelf, the top surface covering assembly having a plurality of segments capable of being joined and un-joined using a dovetail joint, the dovetail joint oriented horizontally when the top surface covering assembly is positioned on the top surface of the wire shelf;

altering the depth of the top surface covering assembly be joining or un-joining one or more segments of the top surface covering assembly, one or more of the dovetail joints being used for joining or unjoining and being oriented horizontally, to correspond to the fixed depth dimension of the associated wire shelf;

providing a front profile, the profile having a depth dimension defined by a back face surface and a front face surface, the back face surface having a slot adapted and configured to receive a segment of the top surface covering assembly and form a horizontally oriented dovetail joint, the front profile being sized to hide the front face of the associated wire shelf and the top surface covering assembly adapted and configured to hide the top surface of the associated wire shelf;

mounting the front profile to the top surface covering assembly by coupling the top surface covering assembly to the slot in the back face surface of the front profile forming a dovetail joint; and securing a retaining clip to the front profile and to the associated wire shelf.

2. A method in accordance with claim 1 where each segment of the plurality of segments includes a tail on a first end and a pin on a second end opposite the first end, the tail and the pin being adapted and configured to interact with other pins and tails, respectively, to form a dovetail joint.

3. A method in accordance with claim 1 wherein securing a retaining clip to the front profile and to the associated wire shelf comprises passing a bolt through a clip and a spacer, threading a nut onto the bolt, placing the clip over a wire rail of the associated wire shelf, placing the nut into a groove in the back surface of the front profile, and tightening the screw until the clip is secured against the wire rail and the spacer, and the spacer is secured against the back surface of the front profile, the clip thereby securing the front profile to the wire shelf and securing the top surface covering assembly to the wire shelf through the dovetail joint connection between the top surface covering assembly and the front profile.

4. A method in accordance with claim 1 further comprising coupling two end caps to the front profile.

5. A method in accordance with claim 1, further comprising coupling a second front profile to the front profile using an intermediate cap having tabs adapted and configured to extend within the front profile and the second front profile, a second top surface covering assembly being coupled to the second front profile.

6. The method of claim 1, wherein the plurality of segments of the top surface covering assembly includes at least one segment having a first depth and at least one segment having a second depth, the second depth being less than the first depth.

7. An assembly for covering an associated wire shelf, the associated wire shelf having a fixed width dimension and a fixed depth dimension, a top support, and a front face, the assembly comprising:

a top surface covering assembly having a plurality of segments capable of being joined and un-joined using a dovetail joint to alter the depth of the top surface covering assembly to correspond to the depth dimension of the associated wire shelf, the top surface covering assembly being adapted and configured to cover the top support of the associated wire shelf, wherein the dovetail joint is oriented horizontally when the top surface covering assembly is positioned on the top surface of the wire shelf;

a front profile attachable to the top surface covering assembly, the front profile having a depth dimension defined by a back profile face surface and a front profile face surface, the front profile face surface sized to hide the front face of the associated wire shelf, the back profile face defining a slot adapted and configured to receive a segment of the top surface covering assembly and form a horizontally oriented dovetail joint; and an attachment mechanism for attaching at least the front profile to the associated wire shelf.

8. The assembly of claim 7 wherein each segment of the plurality of segments includes a tail on a first end and a pin on a second end opposite the first end, the tail and the pin being adapted and configured to interact with other tails and pins, respectively, to form a dovetail joint.

9. The assembly of claim 8 wherein the slot of the front profile is tail adapted and configured to form a dovetail joint with the pin of a segment when the pin is inserted within the tail.

10. The assembly of claim 7 wherein the attachment mechanism comprises a retaining clip, a bolt, a spacer and a nut, wherein the back surface of the front profile defines a groove therein, the retaining clip being adapted and configured to engage with a wire rail of the associated wire shelf and the spacer such that, when installed, the bolt passes through the clip and the spacer and engages with the nut, the nut being within the groove, such that the clip is secured to the associated wire shelf and to the front profile, the clip thereby securing the front profile to the wire shelf and securing the top surface covering assembly to the wire shelf through the dovetail joint connection between the top surface covering assembly and the front profile.

11. The assembly of claim 7 further comprising a plurality of end caps adapted and configured to be coupled to opposing ends of the front profile, the opposing ends being perpendicular to the front surface and the back surface of the front profile.

12. The assembly of claim 11 wherein the front profile comprises a plurality of cavities running the length of the front profile, and wherein each end cap comprises an end surface and a plurality of tabs extending from the end surface, the plurality of tabs adapted and configured to extend within at least one cavity to secure the end cap to the front profile when inserted.

13. The assembly of claim 12 further comprising at least one intermediate cap and at least a second front profile, the intermediate cap comprising a body, a first plurality of tabs extending from one side of the body, and a second plurality of tabs extending from an opposing side of the body, wherein the first plurality of tabs are adapted and configured to extend within at least one cavity of the front profile to secure the intermediate cap to the front profile when inserted, and wherein the second plurality of tabs are adapted and configured to extend within at least one cavity of the second front profile to secure the intermediate cap to the second front profile and secure the front profile to the second front profile.

14. The assembly of claim 13 further comprising a second top surface cover assembly adapted and configured to be coupled to the second front profile.

15. The assembly of claim 7, wherein the plurality of segments of the top surface covering assembly includes at least one segment having a first depth and at least one segment having a second depth, the second depth being less than the first depth.

* * * * *